US008780035B2

(12) United States Patent
Adachi

(10) Patent No.: US 8,780,035 B2
(45) Date of Patent: Jul. 15, 2014

(54) LIQUID CRYSTAL DISPLAY

(75) Inventor: Takeshi Adachi, Saitama (JP)

(73) Assignees: Mitsumi Electric Co., Ltd., Tokyo (JP); ATRC Corporation, Saitama (JP)

( * ) Notice: Subject to any disclaimer, the term of this patent is extended or adjusted under 35 U.S.C. 154(b) by 771 days.

(21) Appl. No.: 13/063,086

(22) PCT Filed: Dec. 10, 2008

(86) PCT No.: PCT/JP2008/072448

§ 371 (c)(1),
(2), (4) Date: Mar. 9, 2011

(87) PCT Pub. No.: WO2010/029650

PCT Pub. Date: Mar. 18, 2010

(65) Prior Publication Data

US 2011/0164050 A1 Jul. 7, 2011

(30) Foreign Application Priority Data

Sep. 12, 2008 (JP) ..... 2008-235233

(51) Int. Cl.

| | |
|---|---|
| ***G09G 5/02*** | (2006.01) |
| ***G09G 3/36*** | (2006.01) |
| ***G09G 3/34*** | (2006.01) |

(52) U.S. Cl.

CPC ..... *G09G 3/3406* (2013.01); *G09G 2330/021* (2013.01); *G09G 2320/0666* (2013.01); *G09G 2320/066* (2013.01); *G09G 2320/0646* (2013.01); *G09G 2360/16* (2013.01); *G09G 3/3611* (2013.01)

USPC ..... 345/102

(58) Field of Classification Search

CPC ..... G09G 3/3659; G09G 3/3406; G09G 2320/0686; G09G 2320/0646

USPC ..... 345/87, 102, 589

See application file for complete search history.

(56) References Cited

U.S. PATENT DOCUMENTS

| | | | | |
|---|---|---|---|---|
| 7,750,582 | B2 * | 7/2010 | Moriyasu et al. | 315/291 |
| 8,228,272 | B2 * | 7/2012 | Peng et al. | 345/87 |
| 8,319,714 | B2 * | 11/2012 | Kojima et al. | 345/89 |
| 2006/0125771 | A1 | 6/2006 | Inuzuka et al. | |
| 2006/0215044 | A1 | 9/2006 | Masuda et al. | |
| 2008/0117160 | A1 | 5/2008 | Oka et al. | |
| 2012/0038544 | A1 * | 2/2012 | Chen | 345/88 |

FOREIGN PATENT DOCUMENTS

| | | |
|---|---|---|
| JP | 2002-041007 | 2/2002 |
| JP | 2002-140038 | 5/2002 |
| JP | 2002-197454 | 7/2002 |

(Continued)

OTHER PUBLICATIONS

Japanese Office Action dated Jun. 28, 2011.

(Continued)

*Primary Examiner* — Abbas Abdulselam
(74) *Attorney, Agent, or Firm* — IPUSA, PLLC

(57) ABSTRACT

A liquid crystal display includes a backlight implemented by an LED (12) and a liquid crystal display element (11). The liquid crystal display performs an image analysis of an image represented by an input image signal and adjusts image quality by performing a control process for the liquid crystal display element (11) and a control process for the backlight implemented by the LED (12) based on results of the image analysis.

4 Claims, 10 Drawing Sheets

(56) References Cited

FOREIGN PATENT DOCUMENTS

| | | |
|---|---|---|
| JP | 2004-029141 | 1/2004 |
| JP | 2006-030588 | 2/2006 |
| JP | 2006-145798 | 6/2006 |
| JP | 2006-267140 | 10/2006 |
| JP | 2006-270421 | 10/2006 |
| JP | 2006-345550 | 12/2006 |
| JP | 2007-272023 | 10/2007 |
| JP | 2007-322944 | 12/2007 |
| JP | 2008-003257 | 1/2008 |
| JP | 2008-129251 | 6/2008 |
| JP | 2008-134466 | 6/2008 |
| JP | 2008-203292 | 9/2008 |

OTHER PUBLICATIONS

Japanese Office Action mailed Mar. 29, 2011.

* cited by examiner

LIQUID CRYSTAL DISPLAY

TECHNICAL FIELD

The present invention generally relates to a liquid crystal display. More particularly, the present invention relates to a liquid crystal display including a light source such as a backlight.

BACKGROUND ART

In response to demands for high-quality liquid crystal displays, technologies for improving the image quality of liquid crystal displays are being developed. A color liquid crystal display normally includes a liquid crystal display element, a color filter, and a backlight. The backlight illuminates the liquid crystal display element from behind, the liquid crystal display element controls transmission of light from the backlight, and the light that passes through the color filter is recognized by human eyes as an image.

A cold cathode fluorescent lamp (CCFL) tube has been widely used as the backlight. However, since the CCFL tube includes hazardous substances such as mercury and consumes a large amount of power, the CCFL tube is being gradually replaced with a light-emitting diode (LED) that is more environment-friendly. A light source using LEDs can be dynamically turned on and off and therefore makes it possible to reduce the power consumption and to improve the image quality and the reliability of a liquid crystal display. For these reasons, LEDs are currently used for liquid crystal displays of small devices such as cell phones and are also starting to be used for liquid crystal displays of larger devices.

FIG. 11 is a drawing illustrating a configuration of a related-art liquid crystal display including a CCFL tube. The liquid crystal display includes a liquid crystal display element 101 and a CCFL tube 102 used as a light source and disposed behind the liquid crystal display element 101. The liquid crystal display also includes a signal processing unit 103 for processing an input image signal and an image quality improving unit 104 for improving the image quality of the image signal. The liquid crystal display element 101 displays an image based on the image signal input from the image quality improving unit 104.

Patent document 1 discloses a method for adjusting image quality of a liquid crystal display.

[Patent document 1] Japanese Laid-Open Patent Publication No. 2008-134466

DISCLOSURE OF INVENTION

Problems to be Solved by the Invention

However, with the liquid crystal display configured as illustrated in FIG. 11, only the liquid crystal display element 101 is controlled to improve the image quality. Also with the configuration of FIG. 11, the luminance of the entire liquid crystal display largely depends on the luminance of the CCFL tube 102 that is a backlight, with a slow response speed. Therefore, increasing the luminance of white also increases the luminance of black, and decreasing the luminance of black also decreases the luminance of white. Thus, it is difficult to accurately adjust the luminance.

FIG. 12 is a graph used to describe a local dimming technology using a top backlight where a screen of a liquid crystal display is divided into areas and the backlight is controlled for the respective areas. With the local dimming technology, as shown in FIG. 12, a luminance change portion 112 of the backlight near a boundary between the areas and a luminance change portion 111 of an image signal overlap each other, but are unnaturally out of synchronization with each other. This may degrade the image quality.

One object of the present invention is to solve or reduce one or more of the above problems and to provide a liquid crystal display that includes a backlight and can display a high-resolution, high-quality image.

Means for Solving the Problems

In an aspect of this disclosure, there is provided a liquid crystal display including a backlight and a liquid crystal display element. The liquid crystal display performs an image analysis of an image represented by an input image signal and adjusts image quality by performing a control process for the liquid crystal display element and a control process for the backlight based on the results of the image analysis.

In the image analysis, the liquid crystal display preferably analyzes a black level, a white level, an average picture level, chromaticity, color, and a spatial frequency component of the image represented by the image signal.

The liquid crystal display preferably performs the control process for the liquid crystal display element after performing the control process for the backlight.

In the control process for the backlight, the liquid crystal display preferably performs black level detection, white level detection, average picture level detection, and color detection in this order for the image represented by the image signal and controls the backlight based on the detection results.

The backlight is preferably implemented by a light emitting diode or multiple light emitting diodes.

In the image analysis, the liquid crystal display preferably performs a macro analysis to analyze luminance, chromaticity, color, and a spatial frequency component of the image represented by the image signal, and a detail analysis to analyze horizontal data and vertical data of the image represented by the image signal.

The liquid crystal display may adjust white balance in the control process for the backlight.

Advantageous Effect of the Invention

An aspect of the present invention makes it possible to provide a liquid crystal display that can display a high-resolution, high-quality image.

EXPLANATION OF REFERENCES

Figure 1:
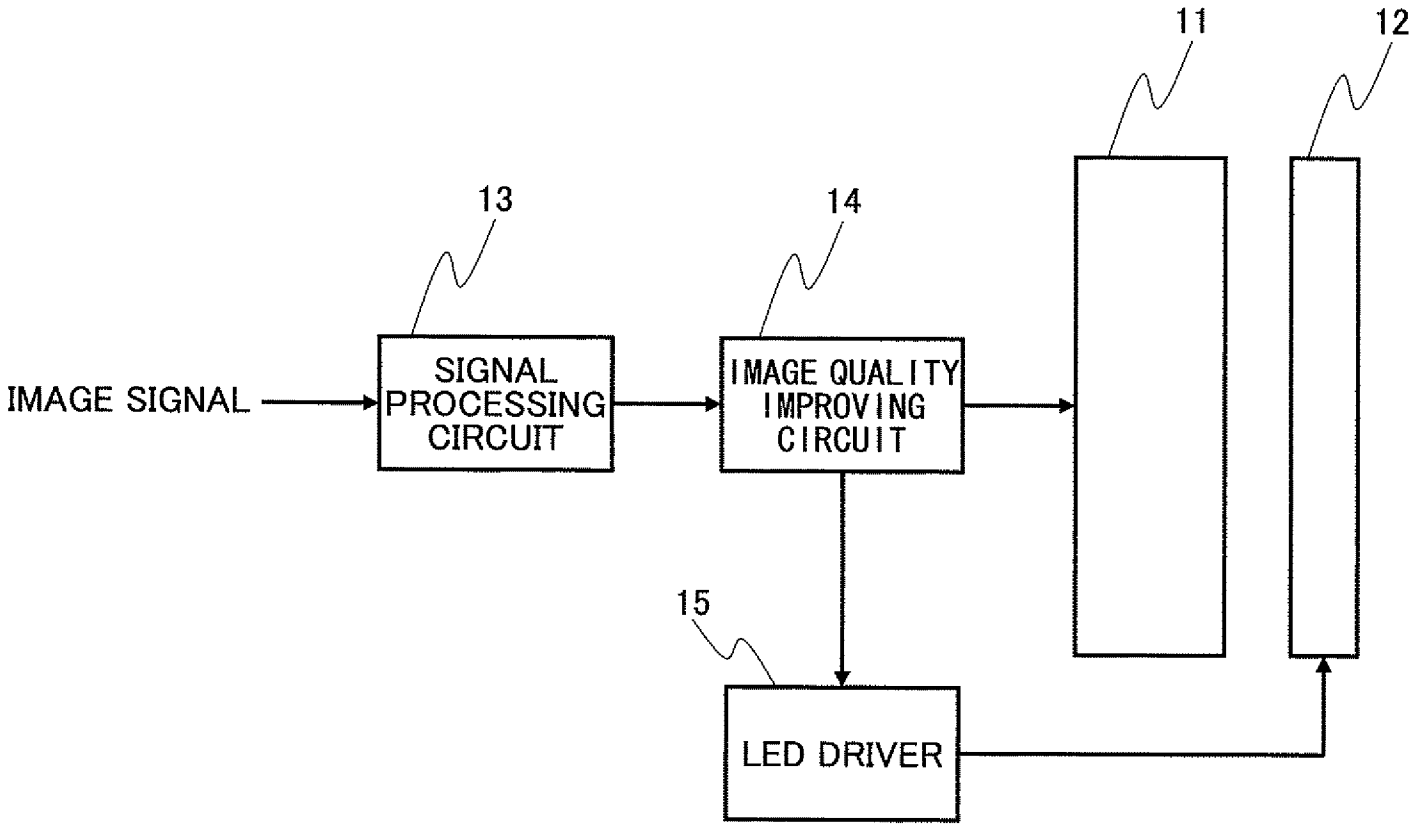
FIG. 1 is a drawing illustrating an exemplary configuration of a liquid crystal display according to an embodiment of the present invention.

11 Liquid crystal display element
12 LED (backlight)
13 Signal processing circuit
14 Image quality improving circuit
15 LED driver
16 Backlight driver
17 Adjuster
21 Profile analysis circuit
22 Horizontal data
23 Vertical data
31 Histogram analysis circuit
32 Luminance histogram
33 Chromaticity histogram
34 Color histogram
35 Spatial frequency histogram
41 Image quality adjusting circuit

BEST MODE FOR CARRYING OUT THE INVENTION

A liquid crystal display according to an embodiment of the present invention is described below.

FIG. 1 is a drawing illustrating an exemplary configuration of a liquid crystal display of this embodiment. The liquid crystal display includes a liquid crystal display element 11 and an LED 12 disposed behind the liquid crystal display element 11 and used as a light source. The liquid crystal display also includes a signal processing unit 13 for processing an input image signal, an image quality improving unit 14 for improving the image quality of the image signal, and an LED driver for controlling the LED 12. The image quality improving unit 14 separately outputs a first signal to a control system of the liquid crystal display element 11 and a second signal to the LED driver 15. The liquid crystal display element 11 is controlled based on the first signal, and the LED 12 is controlled based on the second signal.

This configuration makes it possible to improve the image quality by controlling both the liquid crystal display element 11 and the LED 12 used as a backlight.

Unlike a CCFL tube, an LED has a high response speed. Therefore, it is possible to improve the quality of an image to be displayed on a liquid crystal display by controlling a light source implemented by an LED.

Although an LED is used as the backlight of the liquid crystal display of this embodiment, any other type of light source with a high response speed may instead be used.

Here, if the luminance of the LED 12 is controlled independently of the liquid crystal display element 11, the image quality may not be improved as expected and may instead be reduced.

For this reason, in this embodiment, a macro analysis and a detail analysis are performed on an input image signal, and the liquid crystal display element and the backlight are controlled in relation to each other based on the analyses results. This approach makes it possible to greatly improve the image quality of a liquid crystal display.

More specifically, image quality control parameters are generated based on the results of the detail analysis and the macro analysis of an image represented by the image signal, and the liquid crystal display element and the backlight are controlled in relation to each other based on the image quality control parameters to improve the image quality. This makes it possible to display a high-resolution, high quality image on the liquid crystal display.

Figure 2:
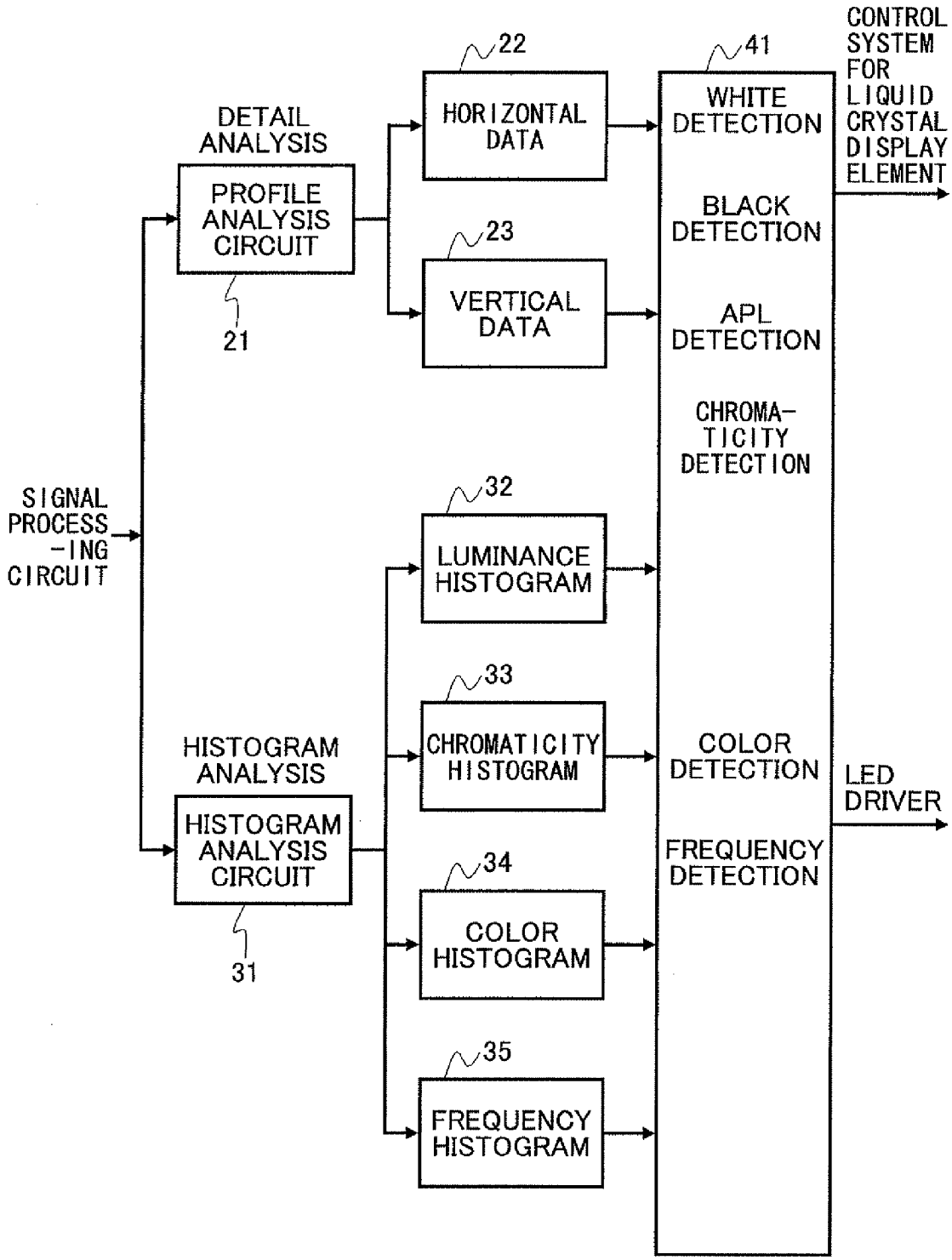
FIG. 2 is a block diagram illustrating components of an image quality improving circuit.

A method of improving the image quality of the liquid crystal display of this embodiment is described below with reference to FIG. 2. An image signal input to the liquid crystal display is input to a profile analysis circuit 21 and a histogram analysis circuit 31 of the image quality improving circuit 14.

The profile analysis circuit 21 performs the detail analysis. More specifically, the profile analysis circuit 21 separately analyzes a horizontal component and a vertical component of the image signal and generates horizontal data 22 and vertical data 23.

The histogram analysis circuit 31 performs the macro analysis. More specifically, the histogram analysis circuit 31 analyzes four factors related to a luminance histogram 32, a chromaticity histogram 33, a color histogram 34, and a spatial frequency histogram 35 and generates those histograms.

Figure 3:
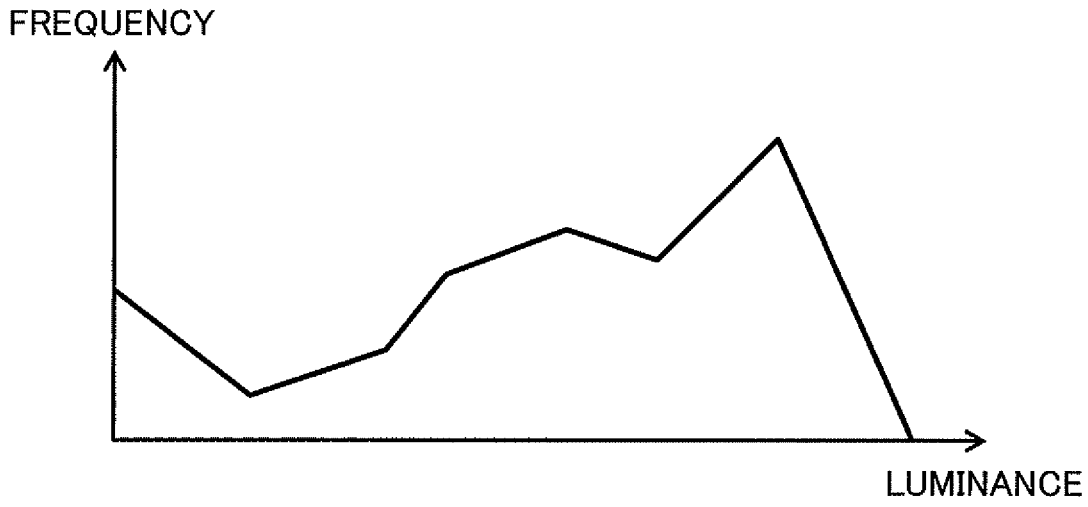
FIG. 3 is a graph showing a luminance histogram.

As illustrated by FIG. 3, the luminance histogram 32 shows a relationship between luminance levels and their frequencies.

Figure 4:
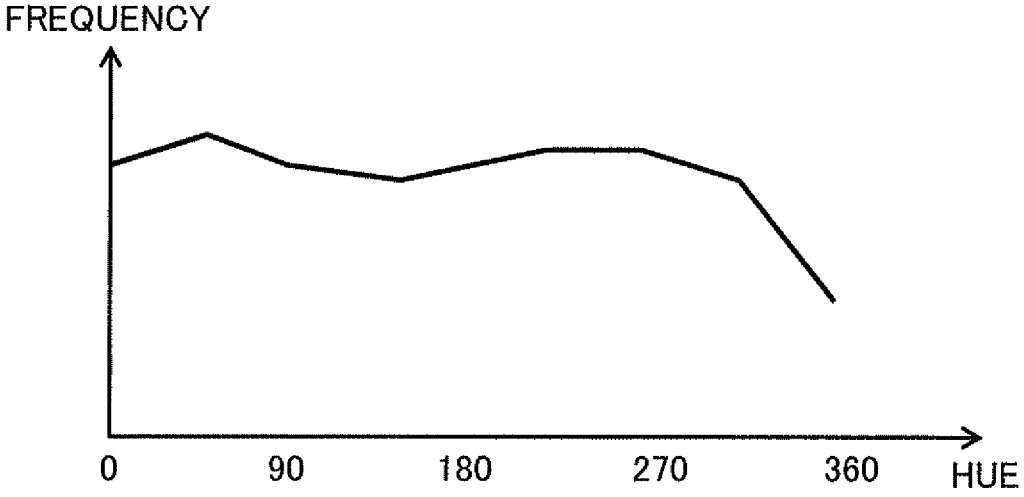
FIG. 4 is a graph showing a chromaticity histogram.

As illustrated by FIG. 4, the chromaticity histogram 33 shows a relationship between angles in a color circle and their frequencies.

Figure 5:
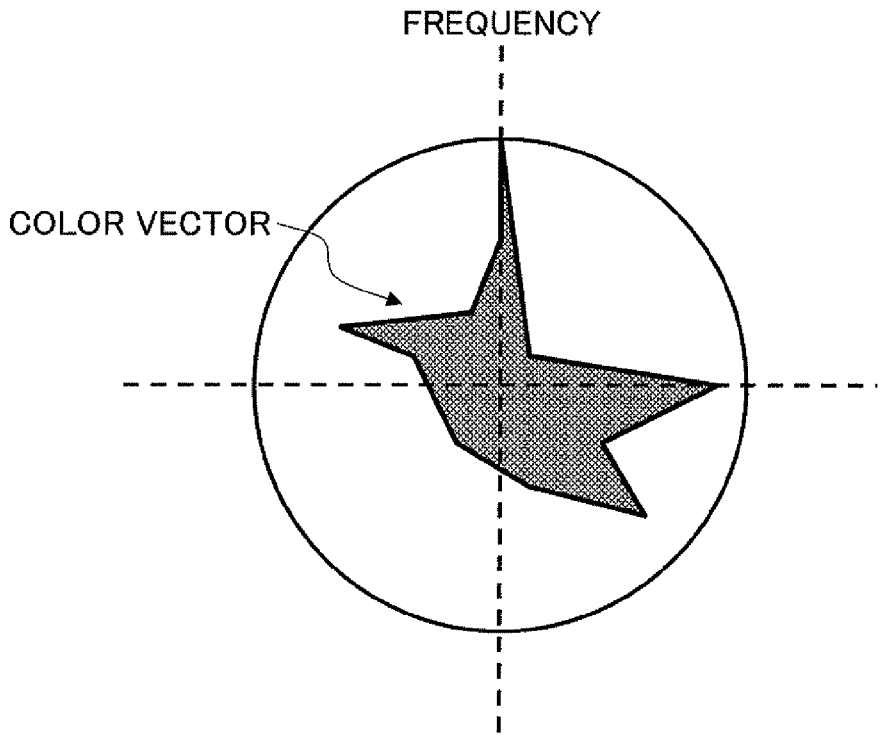
FIG. 5 is a graph showing a color histogram.

As illustrated by FIG. 5, the color histogram is a circular histogram that shows a relationship between colors and their frequencies.

Figure 6:
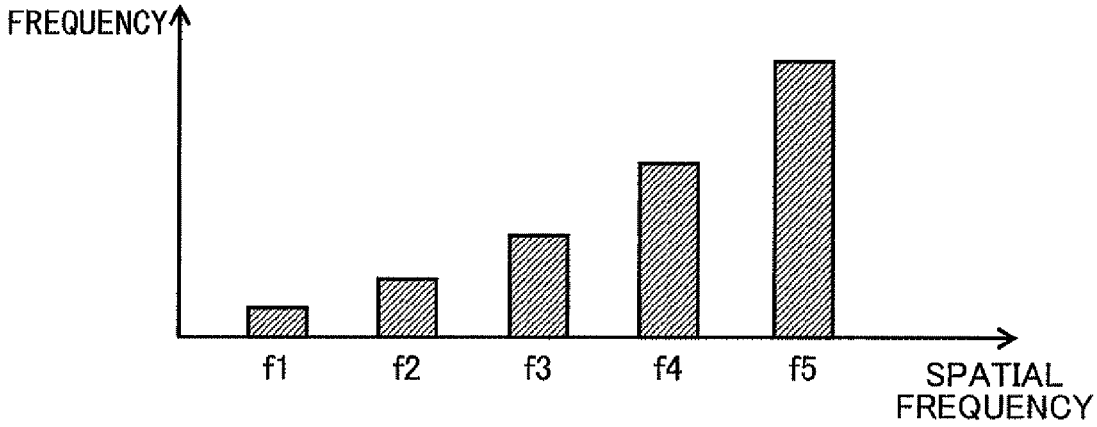
FIG. 6 is a graph showing a spatial frequency histogram.

As illustrated by FIG. 6, the spatial frequency histogram 35 shows a relationship between spatial frequencies and their counts (frequencies).

The horizontal data 22, the vertical data 23, the luminance histogram 32, the chromaticity histogram 33, the color histogram 34, and the spatial frequency histogram 35 are input to an image quality adjusting circuit 41 that performs white detection, black detection, average picture level (APL) detection, chromaticity detection, color detection, and spatial frequency detection for the image represented by the image signal. Based on the detection results, the image quality adjusting circuit 41 outputs a signal for controlling the liquid crystal display element 11 to the control system of the liquid crystal display element 11 and outputs a signal for controlling the LED 12 to the LED driver 15 and thereby improves the image quality of the liquid crystal display.

Next, a method for improving the image quality of a liquid crystal display is described.

In improving the image quality of a liquid crystal display, it is important to adjust basic factors of the liquid crystal display. The basic factors of a liquid crystal display are largely influenced by the backlight such as the LED 12. Particularly, the white balance that affects the luminance, the white level, the black level, and the colors, is an important factor.

Figure 7:
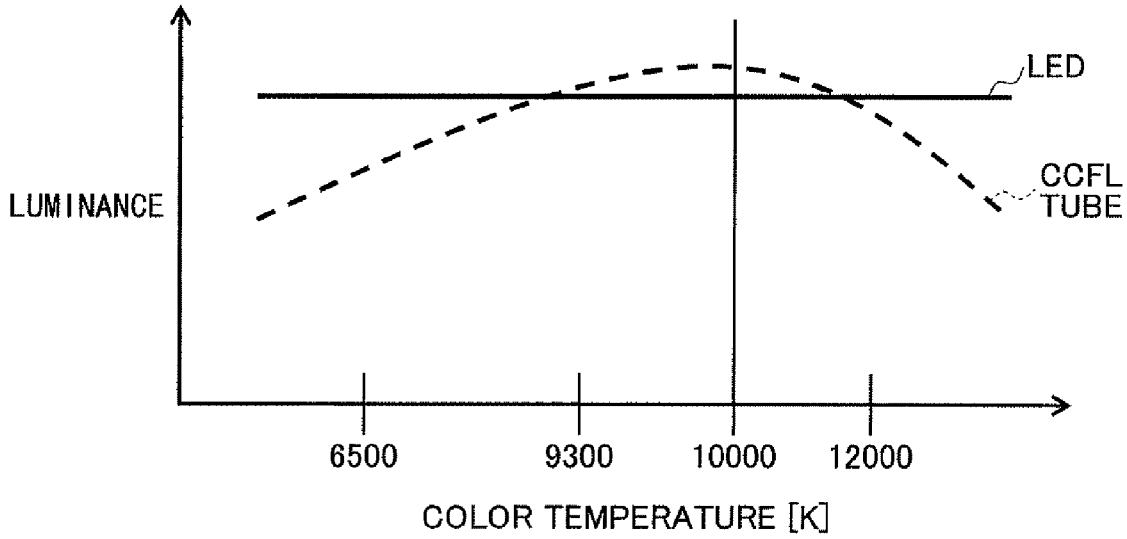
FIG. 7 is a graph showing a relationship between color temperatures and luminance.

FIG. 7 is a graph showing changes in the luminance of a CCFL tube and an LED with respect to the white balance. In FIG. 7, a dotted line indicates the luminance change characteristics of the CCFL tube and a solid line indicates the luminance change characteristics of the LED. In the case of the CCFL tube, the white balance is adjusted to match the peak luminance level and is normally set at a color temperature of about 10000 K. The luminance of the CCFL tube is greatly affected by a change in the white balance. Meanwhile, the luminance of the LED is substantially stable even when the white balance is adjusted by changing the color temperature from 6500 K to 12000 K. Thus, compared with a CCFL tube, using an LED makes it easier to adjust the white balance.

Therefore, an LED is preferably used as a backlight of a liquid crystal display to improve the image quality.

Next, the white balance of a liquid crystal display is described.

Figure 8:
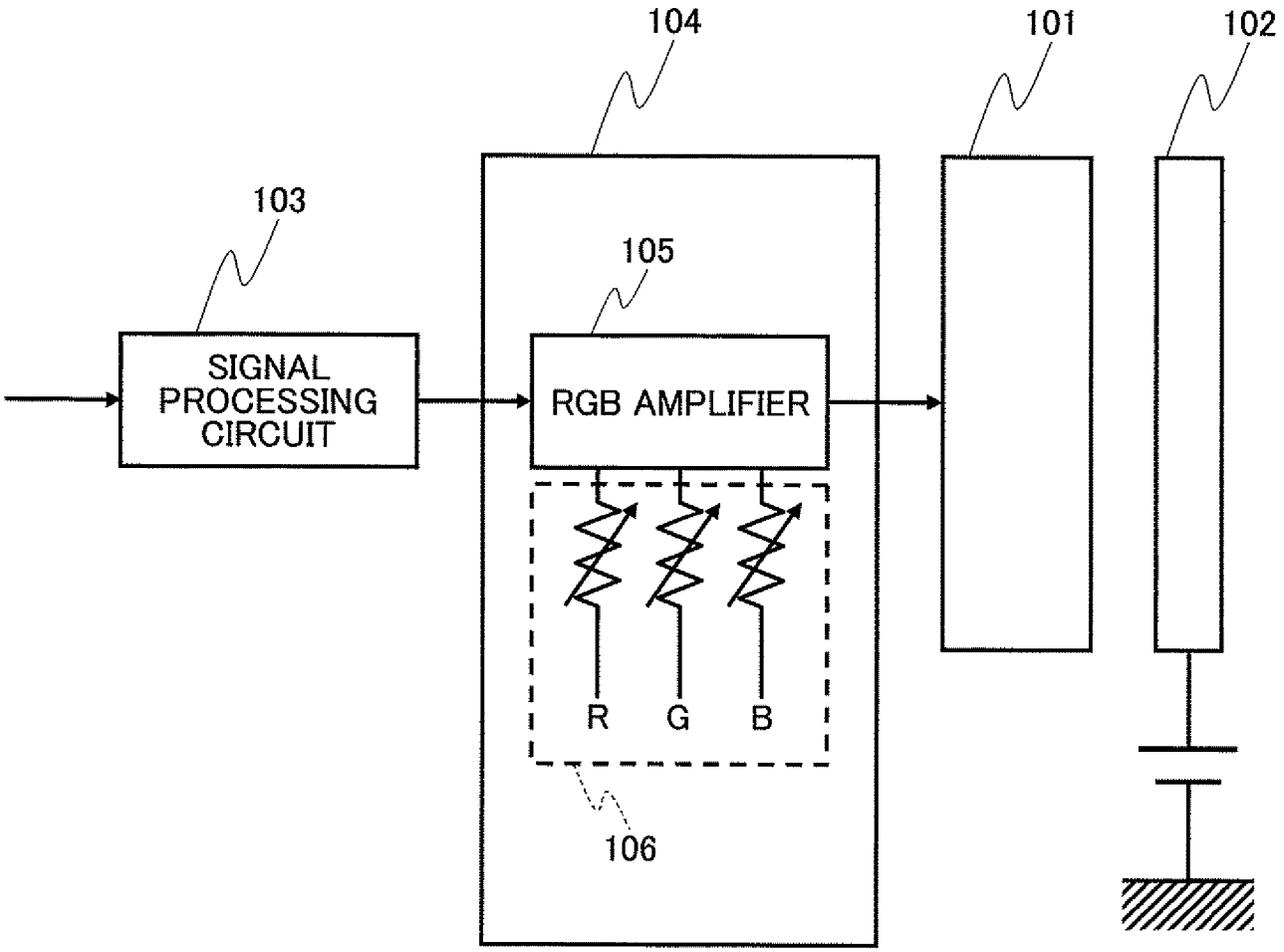
FIG. 8 is a drawing used to describe a method of adjusting white balance in a related-art liquid crystal display.

A method of adjusting the white balance of a related-art liquid crystal display is described below with reference to FIG. 8. In FIG. 8, the liquid crystal display includes a CCFL tube 102 as a backlight for a liquid crystal display element 101.

Here, it is assumed that the color temperature of the CCFL tube 102 is fixed at about 10000 K. The liquid crystal display also includes a signal processing circuit 103 and an image quality improving circuit 104. The image quality improving circuit 104 includes an RGB amplifier 105 and an adjuster 106. The RGB amplifier 105 adjusts the white balance of the liquid crystal display element 101 by controlling biases and gains of RGB components with the adjuster 106.

With this configuration, the signal processing circuit 103 processes an image signal and outputs the processed image signal to the image quality improving circuit 104, the image quality improving circuit 104 adjusts the white balance of the image signal and outputs the adjusted image signal to the liquid crystal display element 101, and the CCFL tube 102 illuminates the liquid crystal display element 101 from behind to display an image.

Figure 9:
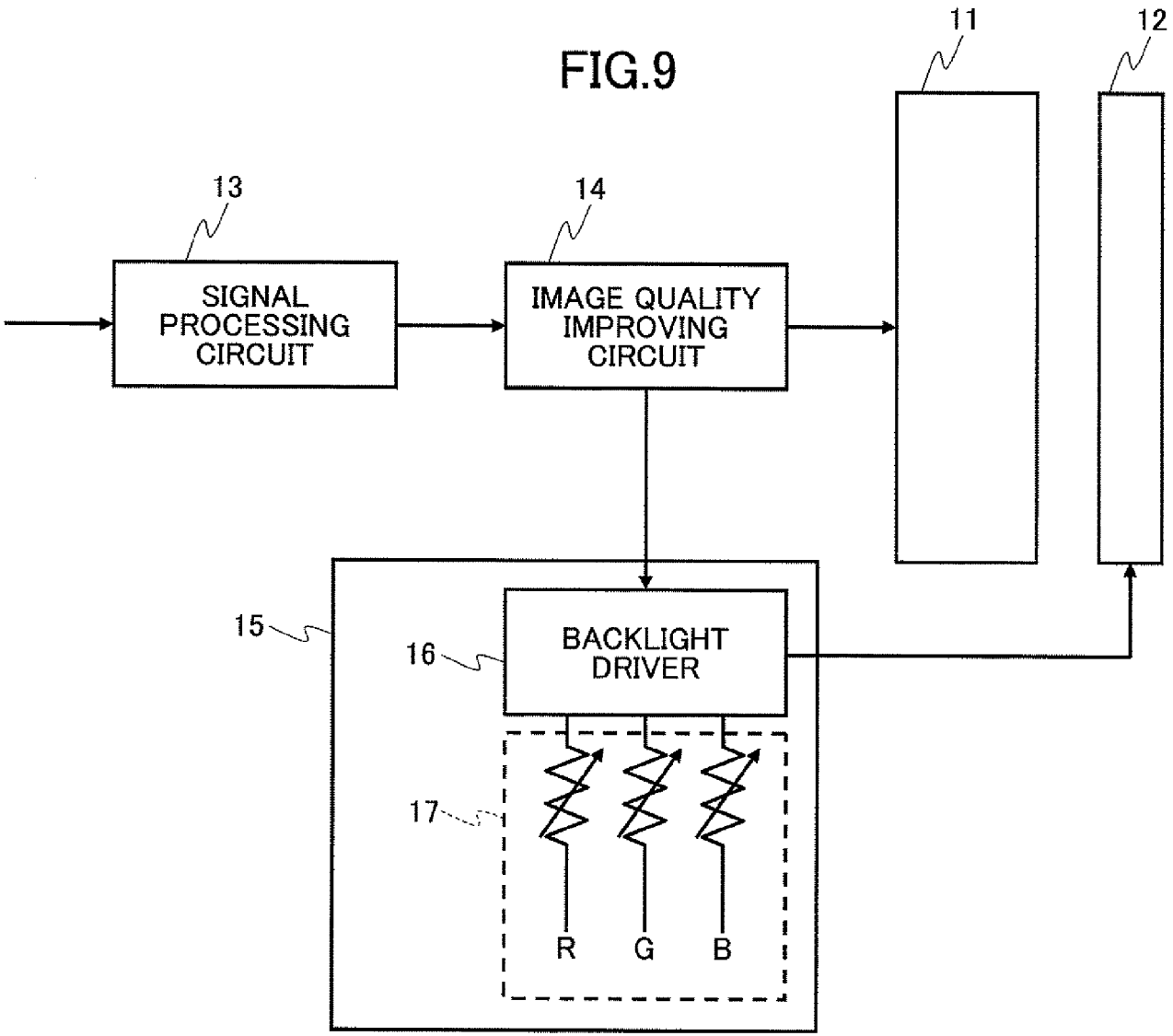
FIG. 9 is a drawing used to describe a method of adjusting white balance in a liquid crystal display according to an embodiment of the present invention.

A method of adjusting the white balance of a liquid crystal display of this embodiment which uses an LED 12 as a backlight for a liquid crystal display element 11 is described below with reference to FIG. 9.

When the LED 12 is used as the backlight for the liquid crystal display element 11, it is possible to adjust the white balance by controlling the LED 12. Therefore, it is not necessary to adjust the white balance by controlling the liquid crystal display element 11. A signal processing circuit 13 processes an image signal and outputs the processed image signal to an image quality improving circuit 14. In this embodiment, the image quality improving circuit 14 does not adjust the white balance. Instead, a control signal requesting to adjust the white balance is sent to an LED driver 15 and the LED driver 15 adjusts the white balance. The LED driver 15 includes a backlight driver 16 and an adjuster 17. The backlight driver 16 controls biases and gains of RGB components with the adjuster 17 and thereby controls the LED 12 to adjust the white balance.

With this configuration, the signal processing circuit 13 processes an image signal and outputs the processed image signal to the image quality improving circuit 14 and the image quality improving circuit 14 outputs the image signal to the liquid crystal display element 11. Meanwhile, the LED 12 illuminates the liquid crystal display element 11 with light the white balance of which is adjusted and as a result, an image is displayed on the liquid crystal display element 11 according to the image signal.

Generally, a television has three to four preset options corresponding to color temperatures between 6500 K and 12000 K and the user can adjust the white balance by selecting one of the preset options. In this case, adjusting the white balance by controlling the liquid crystal display element may reduce the dynamic range or increase the amount of offset of the black level and may degrade the gradation function of the white balance. Meanwhile, when the white balance is adjusted by controlling a backlight implemented by an LED, the adjustment of the white balance does not influence the liquid crystal display element. Therefore, this approach makes it possible to prevent the above problem.

Figure 10:
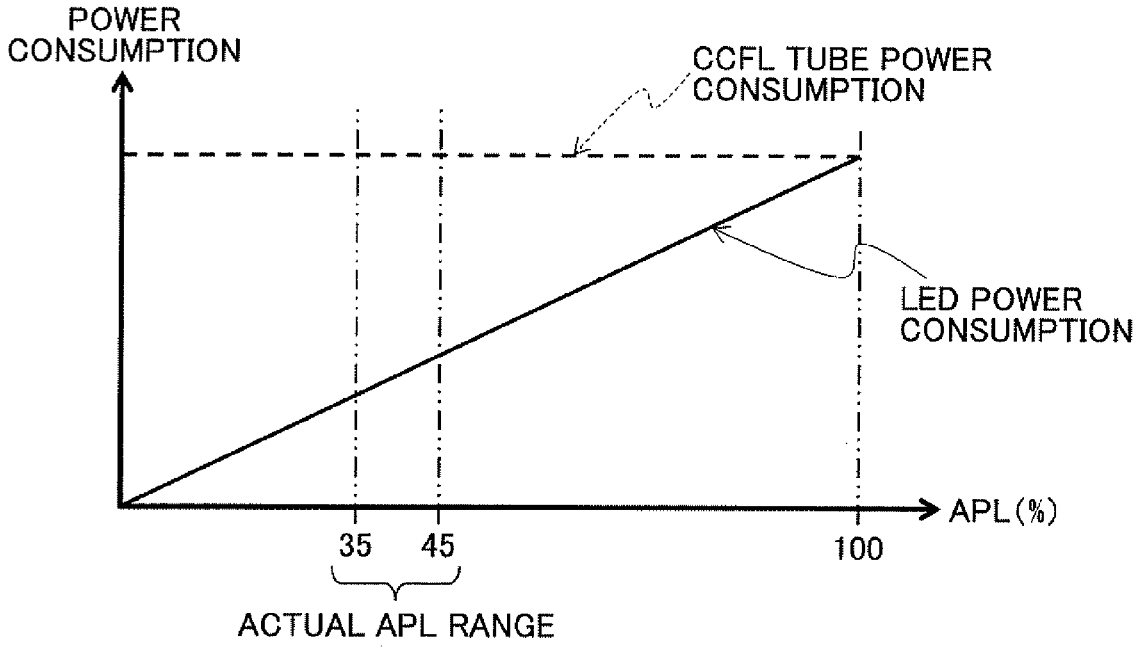
FIG. 10 is a graph showing power consumption of a CCFL tube and an LED.
Figure 11:
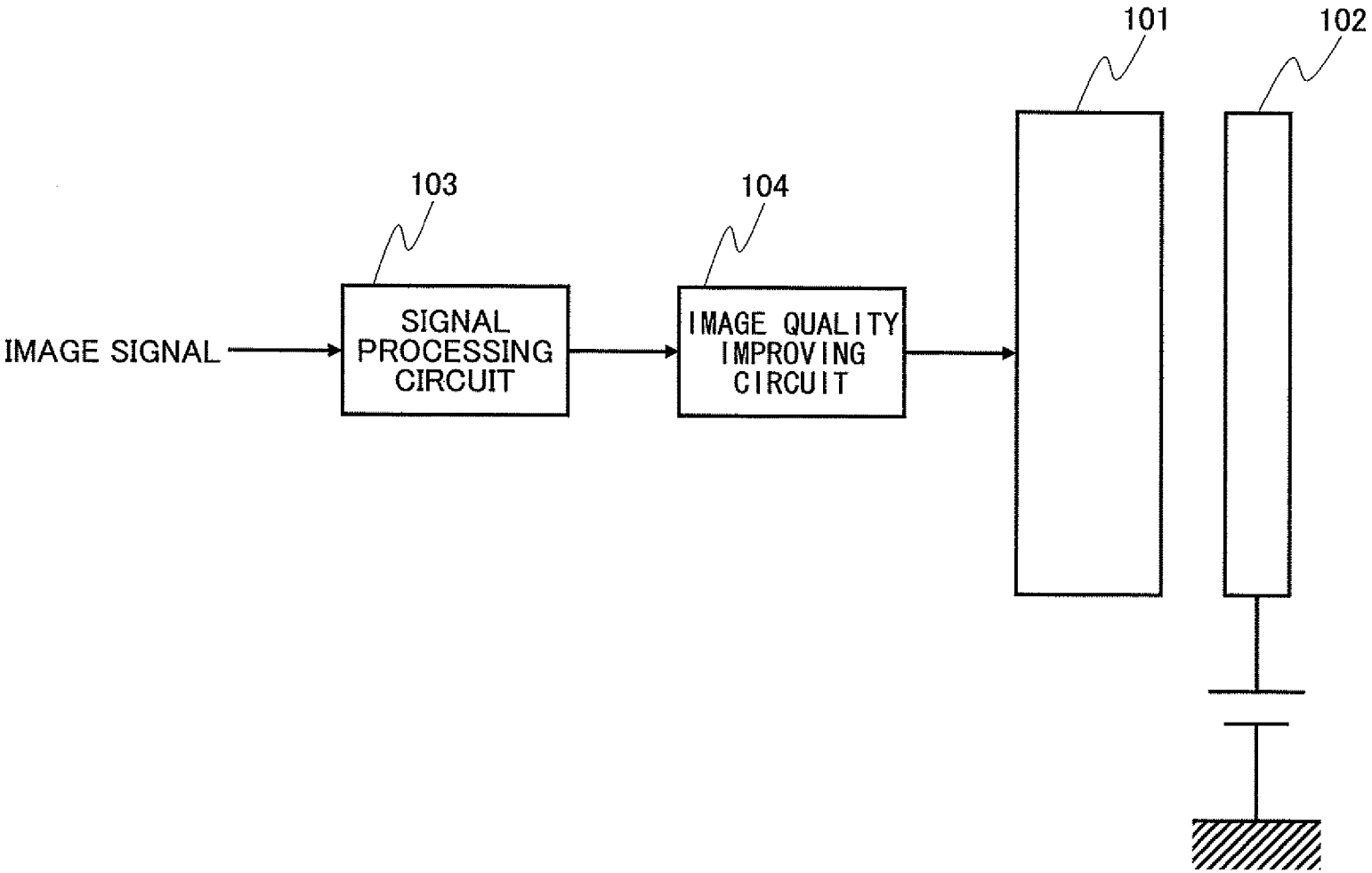
FIG. 11 is a drawing illustrating a configuration of a related-art liquid crystal display.
Figure 12:
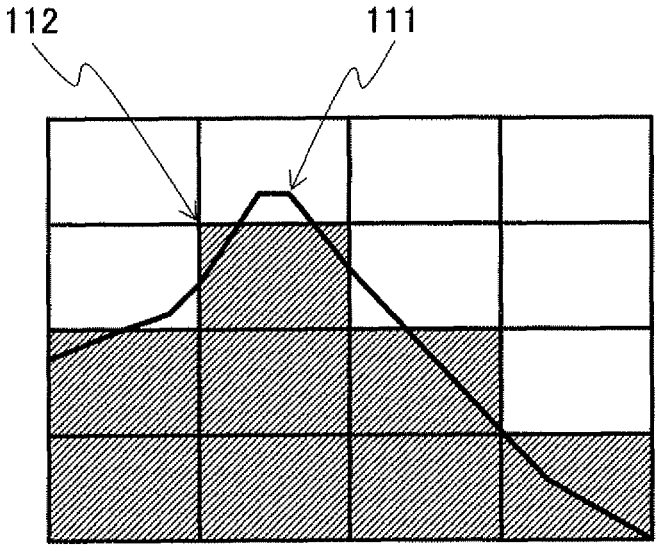
FIG. 12 is a graph used to describe a local dimming technology using a top backlight.

FIG. 10 is a graph showing the power consumption of a liquid crystal display using the CCFL tube 102 as a backlight and the power consumption of a liquid crystal display using the LED 12 as a backlight. As indicated by a dotted line, the liquid crystal display using the CCFL tube 102 consumes a constant amount of power regardless of the average picture level (APL). Meanwhile, as indicated by a solid line, the power consumption of the liquid crystal display using the LED 12 changes in proportion to the APL. The APL of a typical video image of a television is from 35% to 45%. Therefore, when the LED 12 is used, the power consumption can be reduced to a level corresponding to the APL. The power consumption of the liquid crystal display using the LED 12 can be reduced further by 10 to 12% by performing dynamic impulse drive called 0D, 1D, and 2D.

Next, a process for improving the image quality of a liquid crystal display is described. In this embodiment, a control process for the liquid crystal display element 11 is performed after a control process for the LED 12 is performed.

More specifically, black level detection, white level detection, APL detection, and color detection are performed in this order to determine parameters for controlling the LED 12 (backlight).

The black level detection makes it possible to dynamically increase or decrease the luminance of the backlight and thereby makes it possible to greatly reduce the power consumption. Since the backlight is normally at a high luminance level, reducing the luminance of the backlight makes it possible to reduce the power consumption.

The white level detection makes it possible to control the contrast of an image signal. Normally, the backlight is at a high luminance level and a default contrast value is determined based on the high luminance level. The white level detection makes it possible to increase the range of controlling the contrast at the liquid display element and to maintain the luminance of the white level. This in turn makes it possible to prevent the white level from decreasing when the luminance is decreased in the black level detection.

The APL detection makes it possible to balance the luminance of the LED and the contrast of the image signal and thereby to achieve optimum contrast. Thus, the APL detection makes it possible to determine the relationship between the black level and the white level based on the APL and to determine the optimum control parameters for the LED and the contrast of the liquid display element. This in turn makes it possible to reduce the power consumption and to increase the contrast of an image.

The color detection makes it possible to control the amount of shift from a reference white balance value according to the color tone. More specifically, the white balance is shifted from a reference white balance value that is initially determined for black-and-white. For example, the amount of shift is determined based on three typical color detection results: warm, green, and cool. When warm is dominant, the white balance is shifted toward a color temperature of 6500 K to make red more vivid. When green is dominant, the white balance is shifted toward a color temperature of 10000 K to make green more vivid. When cool is dominant, the white balance is shifted toward a color temperature of 12000 K to make blue more vivid.

The color detection is performed based on the color temperature of white in black-and-white, the flesh color, the development of green, the development of red, the development of blue, and the development of intermediate colors (yellow, cyan, and magenta).

After the control process for the LED 12 is performed as described above, a control process for the liquid crystal display element 11 is performed.

For example, black level detection, white level detection, APL detection, color detection, chromaticity detection, and spatial frequency detection are performed in this order to determine parameters for controlling the liquid crystal display element 11.

Since the control process related to the black level, the white level, the APL, and the color has already been performed for the LED 12, the control process for the liquid crystal display element 11 is performed with reference to the results of the control process for the LED 12.

Nonlinear control using a contrast enhancer is performed for the black level, the white level, and the APL. A brightness parameter for adjusting the black level is used only for fine-tuning and is not changed greatly. Also, color and chromaticity parameters are used only for fine-tuning and are not changed greatly. A sharpness function and a noise reduction function may also be directly controlled based on the spatial frequency.

Thus, the black level and the white balance are only fine-tuned in the control process for the liquid crystal display element 11 and are mainly adjusted in the control process for the LED 12. This approach makes it possible to reduce the power consumption and to achieve high contrast and vividness in an interrelated manner.

The present invention is not limited to the specifically disclosed embodiments, and variations and modifications may be made without departing from the scope of the present invention.

Industrial Applicability

The present invention is applicable to a liquid crystal display. More particularly, the present invention is applicable to a liquid crystal display including a light source such as a backlight.

The present international application claims priority from Japanese Patent Application No. 2008-235233 filed on Sep. 12, 2008, the entire contents of which are hereby incorporated herein by reference.

The invention claimed is:

1. A liquid crystal display, comprising:

a backlight; and a liquid crystal display element, wherein the liquid crystal display performs an image analysis of an image represented by an input image signal and adjusts image quality by performing a control process for the liquid crystal display element and a control process for the backlight based on results of the image analysis;

wherein in the image analysis, the liquid crystal display performs a macro analysis to analyze four factors related to a luminance histogram, a chromaticity histogram, a color histogram, and a spatial frequency histogram of the image represented by the input image signal, and generate the histograms, and a detail analysis to separately analyze a horizontal component and a vertical component of the input image signal and generate horizontal data representing the horizontal component and vertical data representing the vertical component;

wherein in the control process for the backlight, the liquid crystal display performs black level detection, white level detection, average picture level detection, and color detection in this order for the image represented by the input image signal based on analysis results of the macro analysis and the detail analysis, and controls the backlight based on results of the detections; and wherein after performing the control process for the backlight, the liquid crystal display performs black level detection, white level detection, average picture level detection, color detection, chromaticity detection, and spatial frequency detection in this order to control the liquid crystal display element.

2. The liquid crystal display as claimed in claim 1, wherein the backlight is implemented by a light emitting diode or a plurality of light emitting diodes.

3. The liquid crystal display as claimed in claim 1, wherein the liquid crystal display adjusts white balance in the control process for the backlight.

4. A method of adjusting image quality of a liquid crystal display including a backlight and a liquid crystal display element, the method comprising:

performing an image analysis of an image represented by an input image signal;

adjusting the image quality by performing a control process for the liquid crystal display element and a control process for the backlight based on results of the image analysis;

performing a macro analysis to analyze four factors related to a luminance histogram, a chromaticity histogram, a color histogram, and a spatial frequency histogram of the image represented by the input image signal, and generating the histograms in the image analysis;

performing a detail analysis to separately analyze a horizontal component and a vertical component of the input image signal and generating horizontal data representing the horizontal component and vertical data representing the vertical component in the image analysis;

performing black level detection, white level detection, average picture level detection, and color detection in this order for the image represented by the input image signal based on analysis results of the macro analysis and the detail analysis, and controlling the backlight based on results of the detections in the control process for the backlight; and after performing the control process for the backlight, performing black level detection, white level detection, average picture level detection, color detection, chromaticity detection, and spatial frequency detection in this order to control the liquid crystal display element.

* * * * *